United States Patent [19]

Curtin

[11] 4,029,571

[45] June 14, 1977

[54] METHOD OF REMOVING CONTAMINANT FROM HYDROCARBONACEOUS FLUID

[75] Inventor: Daniel J. Curtin, Plano, Tex.

[73] Assignee: Atlantic Richfield Company, Dallas, Tex.

[22] Filed: Feb. 25, 1975

[21] Appl. No.: 552,946

[52] U.S. Cl. ..... 208/251 H; 208/251 R; 208/106; 208/107; 208/89

[51] Int. Cl.[2] ..... C10G 23/00

[58] Field of Search ..... 208/251 R, 251 H, 106, 208/151, 8, 11 R, 89

[56] References Cited

UNITED STATES PATENTS

| | | | |
|---|---|---|---|
| 1,990,664 | 2/1935 | Nelson et al. | 208/106 |
| 2,685,561 | 8/1954 | Whiteley et al. | 208/251 H |
| 2,989,459 | 6/1961 | Eastman et al. | 208/107 |
| 3,151,054 | 9/1964 | Layng | 208/11 R |
| 3,151,057 | 9/1964 | Schuman et al. | 208/11 R |
| 3,271,302 | 9/1966 | Gleim | 208/251 H |
| 3,303,126 | 2/1967 | Gleim | 208/251 H |
| 3,365,384 | 1/1968 | Pasternack | 208/251 R |
| 3,738,931 | 6/1973 | Frankovich et al. | 208/89 |
| 3,842,122 | 10/1974 | Wolk et al. | 208/107 |
| 3,910,834 | 10/1975 | Anderson | 208/251 H |
| 3,933,624 | 1/1976 | Myers | 208/251 H |

*Primary Examiner*—Delbert E. Gantz
*Assistant Examiner*—James W. Hellwege
*Attorney, Agent, or Firm*—Hubbard, Thurman, Turner & Tucker

[57] ABSTRACT

A method of removing arsenic and selenium contaminants from a hydrocarbonaceous fluid, such as a synthetic crude oil and fractions thereof, is disclosed. In the disclosed method, the hydrocarbonaceous fluid, containing the contaminant is subjected to a heat treating step for a period of time sufficient to form a precipitate. The thus treated hydrocarbonaceous fluid can then be separated from the precipitate to recover a hydrocarbonaceous fluid having a reduced contaminant content.

9 Claims, 2 Drawing Figures

METHOD OF REMOVING CONTAMINANT FROM HYDROCARBONACEOUS FLUID

BACKGROUND OF THE INVENTION

This invention relates to a method for treating hydrocarbonaceous fluids, such as synthetic crude oils. In another aspect, this invention relates to a method for removing contaminants, such as arsenic and selenium, from a hydrocarbonaceous fluid, such as synthetic crude oil. In still another aspect, this invention relates to a noncatalytic method for removing contaminants, such as arsenic and selenium from a hydrocarbonaceous fluid.

Recent economic and political developments have resulted in dramatic increases in the cost of energy sources such as conventional crude oil and the like. As a result of the increased prices of crude oil and as a result of real and potential shortages of crude oil, various alternative sources of energy are being investigated. It has long been known that there are many alternative sources of energy available but such sources have not been economically competitive with conventional crude oil. Now, it is apparent that the formerly noncompetitive sources of energy will be used to supply an increasing portion of our energy needs in the future. Some of the more promising sources of energy that will be used in the future include synthetic hydrocarbonaceous fluids obtained from oil shale, normally solid coal, tar (including tar sands) and the like. Often, these hydrocarbonaceous fluids are referred to under generic terms such as "synthetic crude oil," or "synthetic oil fractions."

The above-mentioned synthetic hydrocarbonaceous fluids contain contaminants that affect their ability to be readily processed into satisfactory sources of energy and precursors for the synthesis of other desired materials. For example, the above-mentioned synthetic hydrocarbonaceous fluids contain contaminants that tend to interfere with refining and chemical processes such as hydrogenation processes and in some instances they may poison or inactivate catalysts used in such processes. Particularly troublesome contaminants found in such synthetic hydrocarbonaceous fluids include arsenic and selenium contaminants. Even if the above-mentioned synthetic hydrocarbonaceous fluids are employed directly as fuels, the removal of such contaminants may be desirable from an environmental protection standpoint. Thus, it is desirable that such contaminants be removed or reduced to low concentrations in the hydrocarbonaceous fluids before they can be processed or utilized as fuels.

The prior art is replete with various methods for removing contaminants such as arsenic and selenium from hydrocarbon feedstocks. For example, U.S. Pat. No. 2,778,779 discloses a method for removing arsenic from hydrocarbon fractions by using iron, nickel and cobalt oxides as oxidizing agents to oxidize arsenic to a water soluble arsenic oxide. Thereafter, the arsenic oxide is dissolved and removed from the naturally occurring crude oil or oil fraction thereof.

Other methods for removing contaminants such as arsenic from hydrocarbon fractions include catalytic treatment methods such as those disclosed in U.S. Pat. No. 3,622,498 wherein a crude oil having a high metals content is treated in the presence of hydrogen and a slurry of a catalytic metal material to remove the contaminants therefrom.

Sophisticated treatment methods such as disclosed in U.S. Pat. No. 3,496,099 have been utilized to remove contaminants from hydrocarbon fractions by means of a hydrogen treatment method in a catalyst bed which has increasing hydrogenation catalytic activity throughout the bed. While the prior art does provide various methods for removing or reducing the contaminant levels and hydrocarbon fractions, there is still a need for more improved methods for removing contaminants such as arsenic and selenium from hydrocarbonaceous fluids.

SUMMARY OF THE INVENTION

Accordingly, it is an object of this invention to provide a new and improved process for treating hydrocarbonaceous fluids. It is another object of this invention to provide a new and improved process for removing contaminants from hydrocarbonaceous fluids. It is still a further object of this invention to provide a new and improved noncatalytic treatment method for removing contaminants such as arsenic and selenium from hydrocarbonaceous fluids.

Other aspects, objects and advantages of this invention will be apparent to those skilled in the art from the following disclosures and appended claims.

It has now been found that synthetic hydrocarbonaceous fluid feed streams that contain contaminants comprising at least one of arsenic and selenium can be subjected to a noncatalytic heat treating step at a temperature and for a period of time sufficient to form a precipitate. The thus treated synthetic hydrocarbonaceous fluid can then be subjected to a separation step wherein at least a portion of the precipitate is separated from the thus treated synthetic hydrocarbonaceous fluid. The synthetic hydrocarbonaceous fluid recovered from the separation step will have a reduced contaminant level. In carrying out the invention, the synthetic hydrocarbonaceous fluid that is contaminated with the arsenic and selenium contaminants can be subjected to a thermal ("heat soak") treating process to form the precipitate or the synthetic hydrocarbonaceous fluid can be subjected to a noncatalytic heat treating process in the presence of hydrogen, such as a hydrovisbreaking step. Following the noncatalytic heat treating step, the thus treated synthetic hydrocarbonaceous fluid can be separated using conventional separation means to separate at least a portion of the thus formed precipitate from the thus treated synthetic hydrocarbonaceous fluid. The synthetic hydrocarbonaceous fluid that is separated from the precipitate will have a reduced contaminant level of the arsenic or selenium contaminant when compared with the untreated synthetic hydrocarbonaceous fluid feed stream.

DESCRIPTION OF DRAWINGS

The drawings are schematic illustrations of flow schemes of only two of the preferred embodiments of this invention.

In the preferred embodiment shown schematically in FIG. 1, a synthetic hydrocarbonaceous fluid is subjected to a heat treatment process in the presence of hydrogen followed by the separation step to reduce the contaminant level in the product.

DESCRIPTION OF PREFERRED EMBODIMENTS

Figure 1:
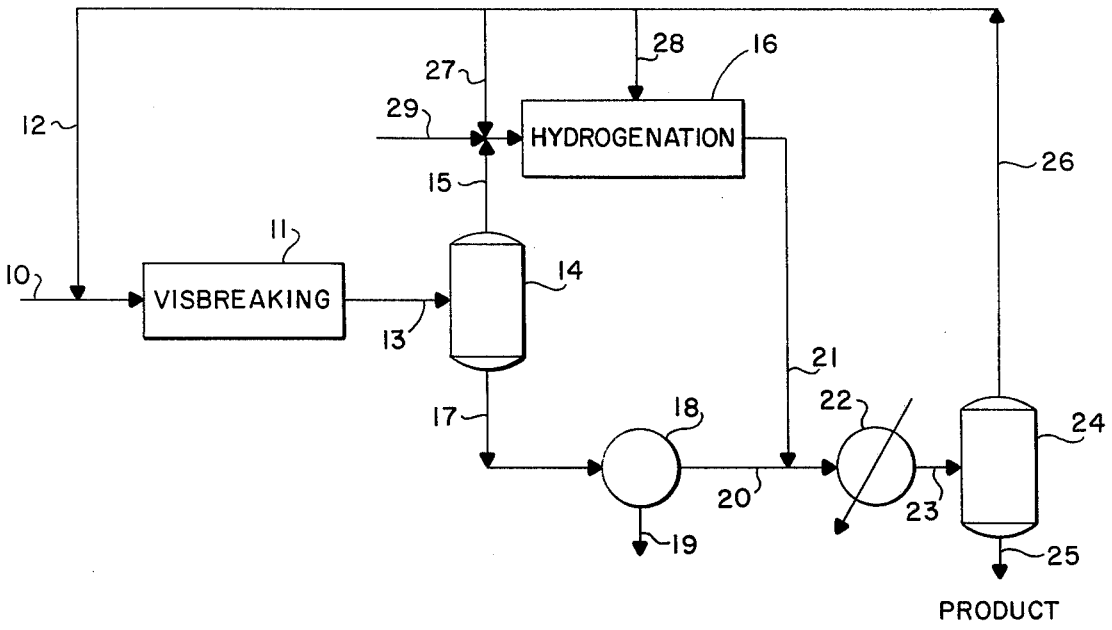
FIG. 1 also illustrates a preferred hydrogenation process integrated with the heat treatment and separation processes.

The preferred embodiments of this invention can be most conveniently described by referring to the drawings. In FIG. 1, a synthetic hydrocarbonaceous fluid feed stream is passed through feed conduit 10 into a heat treatment or vis-breaking zone 11. Hydrogen is added to the synthetic hydrocarbonaceous fluid feed stream by way of hydrogen conduit 12 so that hydrogen with the hydrocarbonaceous fluid feed stream as it is subjected to the elevated temperatures and pressures maintained in visbreaking zone 11.

The heat treated or visbroken oil is removed from vis-breaking zone 11 by way of effluent conduit 13 and passed to a first separation zone 14 wherein the temperature and pressure conditions are maintained close to those of visbreaking zone 11 except for normal temperature and pressure drops due to conduit 13. As the synthetic hydrocarbonaceous fluid feed stream passes through visbreaking zone 11 and as it is held in first separation zone 14, a precipitate is formed in the hydrocarbonaceous fluid. The precipitate, which contains significant amounts of the arsenic, selenium and other contaminants, can be removed from the thus treated synthetic hydrocarbonaceous fluid stream to reduce the contaminant level of the entire treated synthetic hydrocarbonaceous fluid stream. However, in the preferred embodiment illustrated in FIG. 1, and thus treated synthetic hydrocarbonaceous fluid stream is held in first separation zone 14 to allow a portion of the thus treated hydrocarbonaceous fluid stream to vaporize. The vaporized portion of the thus treated synthetic hydrocarbonaceous fluid stream can constitute a major portion (i.e. at least about 50 weight percent based on the total weight of the liquid synthetic hydrocarbonaceous fluid feed stream in conduit 10) of the liquid synthetic hydrocarbonaceous fluid feed stream. The varporized portion of the treated synthetic hydrocarbonaceous fluid feed can be removed by way of vapor conduit 15 and passed to hydrogenation zone 16.

The unvaporized portion of the heat treated or visbroken synthetic hydrocarbonaceous fluid present in first separation zone 15 is removed substantially in a liquid state by way of liquid conduit 17. If it is desired, a suitable heat exchanger, not shown, can be disposed in conduit 17 to lower the temperature of the unvaporized visbroken synthetic hydrocarbonaceous fluid before it is separated from the precipitate. Substantially all of the precipitate formed during the heat treating step will be contained in the unvaporized portion of the visbroken hydrocarbonaceous fluid. The unvaporized portion of the synthetic hydrocarbonaceous fluid, containing the precipitate, is then passed to a second separation means 18 wherein at least a portion of the precipitate is removed from the thus treated synthetic hydrocarbonaceous fluid by known physical separation means. In the preferred embodiment illustrated in FIG. 1, second separation means 18 can be a centrifuge wherein the visbroken synthetic hydrocarbonaceous fluid, containing the precipitate, is centrifuged to produce a slurry of the precipitate and a liquid stream of the hydrocarbonaceous fluid having a reduced contaminant level. The precipitate can be withdrawn from second separation zone 18 by means of precipitate removal conduit 19. As mentioned above, the precipitate will be rich in the arsenic or selenium contaminant that was originally present in the synthetic hydrocarbonaceous fluid feed stream. Thus, the liquid portion of the synthetic hydrocarbonaceous fluid stream exiting the second separation means 18 through filtrate conduit 20 will have a reduced contaminant level when compared with the contaminant level and hydrocarbonaceous fluid feed stream entering through feeding conduit 10.

It should be noted that the unvaporized visbroken synthetic hydrocarbonaceous fluid contained in filtrate conduit 20 has a pour point that is substantially lower than the pour point of the untreated hydrocarbonaceous fluid feed stream entering through conduit 10. Additionally, the pour point of the liquid in filtrate conduit 20 is so stabilized that it will not increase significantly, even upon standing or handling at ambient atmospheric temperatures for long periods of time.

The amount of vaporized hydrocarbon or oil that is removed through vapor conduit 15 can be controlled by the amount of hydrogen that is added to the synthetic hydrocarbonaceous fluid feed stream through hydrogen conduit 12. Generally, the more hydrogen added by way of hydrogen conduit 12, the more hydrocarbon or oil varpor will be removed by way of vapor conduit 15.

Hydrogenation zone 16 is a conventional hydrogenation zone as described hereinafter. The hydrogenated vaporized hydrocarbon or oil is removed from hydrogenation zone 16 by way of hydrogenation effluent conduit 21. All or part of this stream can be combined with all or part of the treated synthetic hydrocarbonaceous fluid in filtrate conduit 20. The thus combined materials are pour point depressed and stabilized oil. Normally it will be desirable to add the hydrogenated oil from hydrogenation zone 16 to the thus treated hydrocarbonaceous fluid at a point downstream of second separation zone 18 because there is little or no precipitate in the hydrogenated oil in hydrogenation effluent conduit 21. Thus, the load on second separation zone 18 can be reduced if it is not necessary to pass the hydrogenated oil therethrough. However, if desired, the streams contained in conduits 17 and 21 can be combined prior to the separation step to remove the precipitate from the heat treated hydrocarbonaceous fluid.

The combined materials in filtrate conduit 20 and hydrogenation effluent conduit 21 can be passed to a conventional cooling means 22 if desired. The combined materials, after cooling, can then be passed by way of transfer conduit 23 to third separation zone 24. Third separation zone 24 is normally maintained at a temperature and pressure to allow hydrogen gas to separate from the liquid oil. The product oil, having a reduced arsenic and selenium contaminant content is removed from third separation zone 24 by means of product conduit 25. Hydrogen gas is removed from third separation zone 24 by means of recycle conduit 26 and can be recycled to the process. The hydrogen containing vapor in recycle line 26 can be compressed by means of any conventional compression means, not shown, for recycle to the process. The hydrogen in recycle conduit 26 is then directed back to hydrogen conduit 12 for addition to fresh hydrocarbonaceous fluid feed stream and to conduit 27 for combining with varporized visbroken hydrocarbonaceous material in vapor conduit 15 and into hydrogenation zone 16 for use as cooling or quenching gas by way of quench conduit 28. Makeup hydrogen for the process can be added as necessary by means of hydrogen makeup conduit 29.

The above-described processing scheme provides for the use of first separating zone 14 that operates at a temperature and pressure substantially the same as the temperature and pressure conditions found in visbreaking zone 11. Thus, a maximum amount of energy is conserved while still separating the material to be hydrogenated from the liquid in the vis-broken product.

Figure 2:
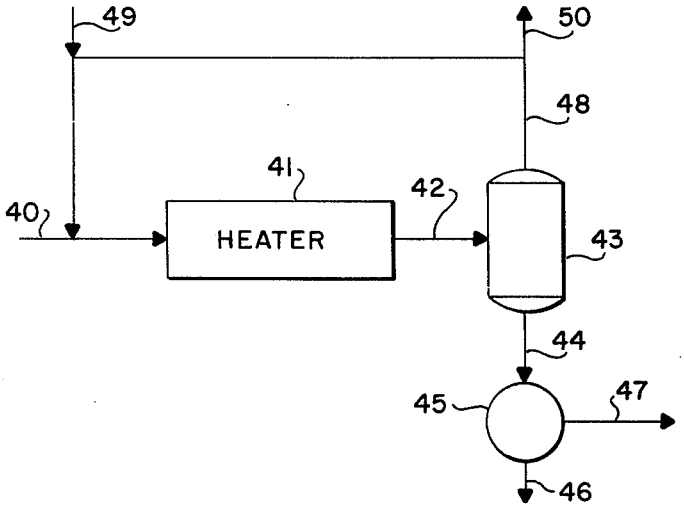
FIG. 2 is a schematic illustration of another preferred embodiment of this invention wherein the synthetic hydrocarbonaceous fluid can be treated with or without hydrogen to produce a product having a low contaminant level.

FIG. 2 schematically illustrates another one of the preferred embodiments of this invention wherein a synthetic hydrocarbonaceous fluid feed stream is introduced by means of feed conduit 40 into heater 41. The synthetic hydrocarbonaceous fluid feed stream is heated to a desired temperature in heater 41 and is withdrawn through effluent conduit 42 and passed to thermal holding (heat soak) zone 43. Thermal holding zone 43 is sized to provide sufficient residence time to allow the heated synthetic hydrocarbonaceous fluid feed stream to be maintained at the desired temperature and pressure conditions to allow the precipitate to form. In those instances where heater 41 operates at sufficiently high temperatures to form the precipitate as the synthetic hydrocarbonaceous fluid passes through the heater, thermal holding zone 43 can be reduced in size or even totally eliminated. Following the desired residence in thermal holding zone 43, the thus treated synthetic hydrocarbonaceous fluid is withdrawn as a liquid through conduit 44 and passed to suitable separation means 45, such as a centifuge, wherein at least a portion of the precipitate is removed by means of precipitate removal conduit 46. Hydrocarbonaceous fluid, having a reduced arsenic and selenium contaminant content is removed from separation means 45 by means of product conduit 47.

If desired, thermal holding zone 43 can be equipped with overhead vapor conduit 48 for removal of vaporized oil and hydrogen gas, if hydrogen is added to the system as hereinafter mentioned. Hydrogen can be added to the synthetic hydrocarbonaceous fluid feed stream by means of hydrogen makeup conduit 49 which is combined with the fresh hydrocarbonaceous fluid stream in feed conduit 40. It may be desirable in some instances to vent at least a portion of the vaporized material from thermal soak zone 43 through vent conduit 50.

The synthetic hydrocarbonaceous fluids that are treated in accordance with this invention are hydrocarbonaceous fluids obtained from oil shale, normally solid coal, tar (including tar sands) and fractions thereof. This invention applies to the treatment of the full range of synthetic hydrocarbonaceous fluids, including whole crude and fractions thereof from residuals or bottoms fractions to overhead fractions obtained by retorting and the like. In some instances, the synthetic hydrocarbonaceous fluids may be referred to as synthetic crude or synthetic oil fractions. The synthetic hydrocarbonaceous fluids described above are known to contain arsenic and selenium impurities or contaminants as well as other impurities or contaminants.

In the instant invention, the synthetic hydrocarbonaceous fluid is heat treated as herein described to produce the precipitate that is removed from the thus treated hydrocarbonaceous fluid. When the term "precipitate" is used herein, it refers to any solid or semi-solid material that is capable of being physically separated from the liquid portion of the heat treated synthetic hydrocarbonaceous fluid. The precipitate can be in the form of hard particles or soft waxy or tarry materials that can be separated from the liquid portion of the heat treated synthetic hydrocarbonaceous fluid by physical separation means. Such physical separation means include separation means wherein the above-mentioned precipitates are separated from the liquid portion of the heat treated hydrocarbonaceous fluid by known size or gravity separation techniques, including settling followed by decantation, filtration, centrifugation and the like.

It has been found that the above-mentioned precipitates contain significant amounts of the arsenic and selenium contaminants that were present in the synthetic hydrocarbonaceous fluid feed thus providing an effective method for removing such contaminants from synthetic hydrocarbonaceous fluids. In addition to the removal of arsenic and selenium contaminants, it has been noted that the above-mentioned precipitates also contain significant amounts of other contaminants present in the feeds including iron, calcium, cobalt, molybdenum, strontium, zinc, nickel, cadmium, silicon, lead, rubidium, copper, potassium and the like.

It should be noted that in most cases the amount of precipitate formed to materially reduce the arsenic and selenium content in the synthetic hydrocarbonaceous fluid is small. It has been found that usually less than 1 part by weight of precipitate per 100 parts by weight of feed material removes significant amounts of the contaminants in the feed in most cases. However, in some instances it may be desirable to heat treat the feed stream under conditions to cause more than 1 part by weight per 100 parts by weight of the feed to precipitate to reduce the contaminant content to a desired level.

In heat treating the synthetic hydrocarbonaceous fluids according to this invention, any conventional methods for applying heat to the fluids can be utilized. Thus, conventional heat exchangers, furnaces and other vessels can be utilized to supply the necessary heat to the synthetic hydrocarbonaceous fluids for the heat treating step of this invention.

In carrying out the heat treatment of the synthetic hydrocarbonaceous fluids in accordance with this invention, it has been found that the fluids should be treated at a temperaure of at least about 600° F. The upper limit for the temperature of the heat treating step, of course, is a function of the length of time that the fluid is maintained at the elevated temperature as well as the amount of cracking or coking that can be tolerated during the heat treating step. Normally, the heat treating step can be carried out at a temperature of from about 600° F to about 1000° F. Preferably, the temperature for carrying out the heat treating step will be from about 750° F to about 850° F.

The pressure for carrying out the heat treating step is preferably a pressure wherein a substantial portion of the synthetic hydrocarbonaceous fluid being treated is maintained in a liquid phase. When the synthetic hydrocarbonaceous fluids are being treated without the addition of hydrogen, the pressure for carrying out the heat treatment step can be at ambient atmospheric pressures or higher if desired, so long as a substantial portion of the feed being treated is maintained in a liquid phase. Generally, the pressure for carrying out the heat treating step will be at least about 500 psig when hydrogen is added to the synthetic hydrocarbonaceous fluid for the heat treating step.

The length of time that the hydrocarbonaceous fluids are maintained at the elevated temperatures during the heat treating step will vary according to the temperature as well as the amount of cracking and coking that can be tolerated during the heat treating step. When the hydrocarbonaceous fluid is heat treated at rather mild temperature conditions, the length of time for the heat treating step will be longer than when the heat treating step is carried out at a higher temperature. Normally, the period of time for carrying out the heat treating step will be at least about 0.5 seconds. It some instances, it may be desirable to include holding vessels or thermal holding ("heat soak") zones in continuous process equipment to hold the heated hydrocarbonaceous fluid at the proper temperature for a sufficient length of time to affect the formation of the contaminant rich precipitate.

The heat treating step can be carried out either in the presence of or the absence of hydrogen. It has been found that when the heat treating process is carried out without the addition of hydrogen, that the conditions for carrying out the heat treating step will generally be at a temperature of from about 600° F to about 1000° F for a period of time of at least 0.5 seconds at a pressure wherein a substantial portion of the hydrocarbonaceous fluid is maintained in a liquid phase. The exact length of time that the hydrocarbonaceous fluid is maintained at the elevated temperature is a matter of choice that is dictated by the length of time necessary for the precipitate to form as well as the extent of any thermal cracking or coking that can be tolerated during the heat treating step. Some non-limiting exemplary temperature and residence times for treating a contaminated shale oil in the absence of hydrogen to form the precipitate include treating the shale oil at 850° F for 10 seconds and at 750° F for one hour.

It has been found that the presence of hydrogen during the heat treating step is beneficial in that the degree of removal of the arsenic or selenium contaminants is improved. Additionally, the presence of hydrogen during the heat treating step will enable the process of this invention to be carried out at generally shorter residence times due to the fact that higher temperatures can be utilized for the heat treating step without excessive coke formation. When hydrogen is present during the heat treating step, the resulting liquid product will have a stable reduced pour point as compared to the pour point properties of the feed material.

In one of the preferred embodiments of this invention, hydrogen is utilized in the thermal treating step of the hydrocarbonaceous fluid. The conditions maintained in such a preferred embodiment of this invention are at a temperature of from about 600° to about 1,000° F, preferably from about 650° to about 850° F; a pressure of at least 500 psig, preferably from about 500 to about 1500 psig and a time of at least about 3 minutes, preferably from about 3 to about 30 minutes. The amount of hydrogen consumed during such a heat treating process is from about 50 to about 200 standard cubic feet (scf) per barrel of the synthetic hydrocarbonaceous oil being treated. One of the additional benefits obtained by carrying out such a heat treating process in the presence of hydrogen to form the precipitate that is removed from the synthetic hydrocarbonaceous fluid to thereby remove the arsenic and selenium contaminants is in the pour point reduction of the hydrocarbonaceous fluid being treated. When hydrogen is present during the heat treating process, it is preferable to maintain the hydrogen partial pressure in excess of 500 psig.

Some non-limiting exemplary temperature and residence times for treating a contaminated synthetic hydrocarbonaceous fluid in the presence of hydrogen to form the precipitate include treating the hydrocarbonaceous fluid at 850° F for 0.5 seconds and at 750° F for 20 minutes.

Following the heat treating and separation steps to remove at least a portion of the arsenic or selenium contaminants, the hydrocarbonaceous fluid, having reduced impurity levels, can be refined, treated or used in any desirable manner. Because of the low levels of arsenic and selenium contamination, the treated products produced with this invention are particularly applicable to subsequent refining and/or treatment steps wherein operations would be impaired if the arsenic and selenium contaminants were present.

In the preferred embodiment set forth in FIG. 1, the varporized oil withdrawn from the first separation zone 14 is passed to hydrogenation zone 16 wherein it is hydrogenated. Known hydrogenation catalysts such as a combination of group VI metal (e.g. chromium, molybdenum and/or tungsten) with a group VIII metal such as iron, nickel and/or cobalt can be used. The hydrogenation step illustrated in FIG. 1 for hydrogenating the vaporized hydrocarbonaceous fluid will produce a hydrogenated oil that can be at least partially combined with the treated hydrocarbonaceous fluid having a reduced contaminant level of the arsenic or selenium contaminants.

In the flow scheme illustrated in FIG. 2, hydrogen can be added to the heat treating step if desired by means of hydrogen makeup conduit 49. Of course, if hydrogen is unavailable or it is not desired to add hydrogen to the heat treating step illustrated in FIG. 2, the heat treating step can be merely carried out by heating the hydrocarbonaceous fluid and thereafter separating the thus formed precipitate from the fluid to produce having a reduced arsenic or selenium contaminant level.

Following the heat treatment step, whether in the presence or absence of hydrogen, the precipitate can be separated from the thus treated hydrocarbonaceous fluid by any known means. Such known means include settling tanks, filters, centrifuges and the like. In commercial operations, centrifuging the treated hydrocarbonaceous fluid offers a very attractive method for removing the precipitate to produce the product having the reduced arsenic and selenium contaminant level. Conventional centrifuge equipment can be utilized for such a separation.

In some instances it may be desirable to cool the heat treated synthetic hydrocarbonaceous fluid prior to the separation of the precipitate therefrom. Such a cooling step is entirely one of choice. However, from a standpoint of convenience, the separation step will generally be carried out at a temperature of below about 450° F.

While the foregoing process has been described in terms of a noncatalytic process, it will, of course, be appreciated that it can be used in conjunction with catalytic processes wherein the feed stream can be catalytically treated before the heat treating step or the heat treated hydrocarbonaceous fluid can be catalytically treated before the separation step.

It will, of course, be understood that the above-described process for removing arsenic and selenium contaminants from synthetic hydrocarbonaceous fluids can be carried out on either a batch or continuous scale.

The following examples are presented to illustrate embodiments of the present invention. The examples are given for illustrative purposes only and are not intended to limit the scope of the invention. In the examples, standard X-ray fluorescent techniques were utilized to determine arsenic content in the feed materials and in the product. In the examples, the separation step was carried out by centrifuging at least a portion of the heat treated synthetic hydrocarbonaceous fluid in a standard laboratory centrifuge by placing a sample of the heat treated hydrocarbonaceous fluid in a clean glass 100 cc centrifuge tube and thereafter centrifuging the sample at about 2500 rpm for at least 15 minutes, followed by a decantation of the liquid from the top of the centrifuge tube.

EXAMPLE 1

A crude shale oil obtained by retorting Colorado shale oil was fractionated to provide a light fraction consisting of about 70% by volume of the crude oil and a residue. The residue portion was charged to a rocker bomb reactor that was equipped with an external electric heating coil. Air was purged from the reactor with nitrogen and the reactor was thereafter sealed and heated to a temperature of 750° F for a period of 30 minutes. The pressure during the heat treating step was 600 psig. Following the heating step, the thus treated residue portion was centrifuged and the total liquid resulting from the centrifuging step was blended with the light fraction that was previously distilled from the crude oil. The crude oil had an arsenic content of 20.1 ppm and the reconstituted blend of the light fraction and the treated residue had an arsenic content of only 13 ppm, resulting in a reduction of over 35% of the arsenic in the crude shale oil. The crude shale oil had a pour point of 75° F and the pour point of the reconstituted blend was between −25° F and −30° F.

EXAMPLE 2

The procedure of Example 1 was followed using the same feed material but the residue was heated for 90 minutes at 750° F. Following the separation and reblending of the heat treated residue with the light fraction, it was found that the reconstituted product had an arsenic content of 13 ppm, also resulting in a reduction of over 35% of the arsenic of the arsenic in the crude oil. The pour point of the reconstituted blend in this example was −30° F.

EXAMPLE 3

From a crude shale oil obtained by retorting Colorado oil shale, a gas oil fraction having a boiling range of 400° F to 950° F was isolated. The gas oil fraction had an arsenic content of 42 ppm. The gas oil fraction was charged to the rocker bomb apparatus of Example 1 and the reactor was purged with nitrogen gas and pressurized. The sealed reactor was heated at 804° F for 26.7 minutes with the pressure during the heating step being 2400 psig. Following the heating step, the treated gas oil was centrifuged and the resulting liquid fraction was found to contain 11 ppm arsenic. The total precipitate was collected and washed. The precipitate amounted to only 0.03 weight percent of the total gas oil feed to the reactor.

EXAMPLE 4

A full range shale oil obtained by retorting Colorado oil shale was charged to the reactor of Example 1. The reactor was then pressurized with hydrogen and heated to a temperature of 800° F for a period of 28 minutes at a pressure of 1400 psig. The calculated amount of hydrogen charged to the reactor was approximately 1000 standard cubic feet per barrel of oil. The shale oil feedstock had an arsenic content of 17.4 ppm and a pour point of 75° F. The liquid product recovered from the centrifuging separation step had an arsenic content of 2 ppm and a pour point of −30° F.

EXAMPLE 5

A gas oil fraction of shale oil as described in Example 3 was charged to a reactor similar to that of Example 1 and the reactor was pressurized with hydrogen in a calculated amount of 2000 standard cubic feet of hydrogen per barrel of oil. The sealed reactor was then heated to 750° F for 27 minutes at a pressure of 2250 psig. The gas oil charged to the reactor had an arsenic content of 42 ppm and the recovered liquid product following the centrifuging separation step had an arsenic content of 4.8 ppm. The amount of precipitate formed in the treating step amounted to less than 0.01% by weight of the gas oil charged to the reactor.

EXAMPLE 6

A gas oil similar to that of Example 3 and having a arsenic content of 38.7 ppm was charged to a reactor similar to that described in Example 1. The reactor was pressurized with hydrogen in a calculated amount of 2000 standard cubic feet of hydrogen per barrel of the gas oil. The sealed reactor was then heated at 801° F for 27.7 minutes at a pressure of 1675 psig. The arsenic content of the gas oil feed was 38.7 ppm and the arsenic content of the treated gas oil was 1.4 ppm. The amount of precipitate was less than 0.01% by weight of the gas oil charged to the reactor.

EXAMPLE 7

A continuous run was carried out in which a full-range shale oil obtained by retorting Colorado oil shale was heat treated in the presence of hydrogen by passing a mixture of the shale oil and hydrogen through a 3½ inch long stainless steel reactor having an inside diameter of ⅜ inches that was filled with glass beads. The reactor was heated by means of an external electric heater such that the temperature inside the reactor was 800° F. Hydrogen was mixed with the shale oil in a calculated amount of 4000 standard cubic feet of hydrogen per barrel of oil. The reactor was maintained at 2000 psig and the residence time of the reactor was 13.1 seconds. The arsenic content of the shale oil feed was 19.4 ppm and the arsenic content of the liquid product product was 4 ppm. The precipitate formed in this run amounted to only 0.06% by weight of the total feed to the reactor.

Various changes and modifications may be made in the foregoing disclosure without departing from the spirit and scope of the invention.

I claim:

1. A method for removing a contaminant comprising at least one of arsenic and selenium from a synthetic hydrocarbonaceous fluid feed stream obtained from oil shale comprising the steps of noncatalytically heat treating said feed stream at a temperature of at least about 600° F and at a pressure such that a substantial portion of said feed is maintained in a liquid phase for a period of time sufficient to form a precipitate; and thereafter separating at least a portion of said precipitate from the thus treated synthetic hydrocarbonaceous fluid.

2. The method of claim 1 wherein said feed stream is heat treated in the presence of hydrogen.

3. The method of claim 2 wherein the partial pressure of said hydrogen is at least 500 psig during at least a portion of said heat treating.

4. The method of claim 3 wherein said separating is carried out by filtering said thus treated synthetic hydrocarbonaceous fluid.

5. The method of claim 4 wherein said feed stream is heat treated at a temperature of from about 750° F to about 850° F.

6. The method of claim 1 wherein said feed stream is heat treated at a temperature of from about 750° F to about 850° F.

7. The method of claim 1 wherein said precipitate is less than 1 part by weight per 100 parts by weight of said fluid feed stream.

8. The method of claim 1 wherein said separating is carried out by centrifuging said thus treated synthetic hydrocarbonaceous fluid.

9. The method of claim 1 wherein said separating is carried out by filtering said thus treated synthetic hydrocarbonaceous fluid.

* * * * *